US005272611A

United States Patent [19]

Lai

[11] Patent Number: 5,272,611

[45] Date of Patent: Dec. 21, 1993

[54] ELECTRICAL CORD ASSEMBLY FOR ILLUMINATION-ADJUSTABLE LIGHTING FIXTURE

[76] Inventor: Shih-Wang Lai, P.O. Box 55-1670, Taipei, Taiwan

[21] Appl. No.: 967,738

[22] Filed: Oct. 28, 1992

[51] Int. Cl.[5] ..... F21V 29/00

[52] U.S. Cl. ..... 362/373; 369/249; 369/251; 369/11; 174/50

[58] Field of Search ..... 362/373, 3, 6, 10, 11, 362/85, 95, 251, 250, 249; 174/50, 50.54, 52.1, 65 R, 655 S

[56] References Cited

U.S. PATENT DOCUMENTS 3,725,695 4/1973 Eversberg et al. ..... 362/394
4,780,799 10/1988 Groh ..... 362/373 X
4,937,717 6/1990 Betzvog, Jr. ..... 362/373 X

*Primary Examiner*—Larry Jones

[57] ABSTRACT

An electrical cord assembly for lighting fixture includes: a main cord connected to a power source, an illumination adjusting switch box connected with the main cord secured on a supporting stand, at least a lamp cord branched from the main cord through the switch box and connected to at least a lamp secured on the stand through a lamp adapter, wherein the switch box is formed by integrally molding an outer jacket on an inner box for ensuring a water proof property for the power connection, and the inner box having a plurality of fins protruding outwardly from the jacket, and the lamp adapter is also well shielded for water proof purpose, thereby forming an electrical cord system easily assembled for saving assembly labor cost and for providing a lighting fixture for a quicker lighting service, and for effectively dissipating heat in the box for enhancing electrical safety.

6 Claims, 6 Drawing Sheets

ELECTRICAL CORD ASSEMBLY FOR ILLUMINATION-ADJUSTABLE LIGHTING FIXTURE

BACKGROUND OF THE INVENTION

A conventional lighting fixture for mounting a plurality of lamps or lights on a stand is provided with an electrical cord system which may include a main cord connected with several branched cords for powering the lamps. Each lamp is connected with a branched cord powered from the main cord by means of a switch box having a regulating switch provided on each switch box for switching on or off the lamp and for adjusting the illumination of each lamp. However, for connecting the cords in such a conventional lighting fixture, it requires complex procedures for connecting the cords for their power supply, causing inconvenience for a lighting engineering. Meanwhile, the lighting fixture provided for exterior activities outside a room may be subjected to rain or moisture attack and the conventional switch boxes of the lighting fixture are always not water proof, thereby being vulnerable to be damaged by rainy water or moisture or possibly causing electrical shock accident when the electrically connecting parts of the lighting fixture is moistened and contacted by any persons who touch such a wet lighting fixture. Such a conventional switch box is also not provided with efficient heat-radiating device so that the electric heat accumulated in the switch box may influence the electrical safety.

It is therefore expected to disclose an electrical cord system having water-proof property, heat dissipation effect and easier assembly to be installed on a lighting fixture.

SUMMARY OF THE INVENTION

The object of the present invention is to provide an electrical cord assembly for lighting fixture including: a main cord connected to a power source, an illumination adjusting switch box connected with the main cord secured on a supporting stand, at least a lamp cord branched from the main cord through the switch box and connected to at least a lamp secured on the stand through a lamp adapter, wherein the switch box is formed by integrally molding an outer jacket on an inner box for ensuring a water proof property for the power connection having a plurality of radiating fins protruding outwardly from the inner box for dissipating heat outwardly, and the lamp adapter is also well shielded for water proof purpose, thereby forming an electrical cord system easily assembled for saving assembly labor cost, for providing a lighting fixture for a quicker lighting service, and for preventing heat accumulation in the switch box ensuring electrical safety.

DETAILED DESCRIPTION

Figure 1:
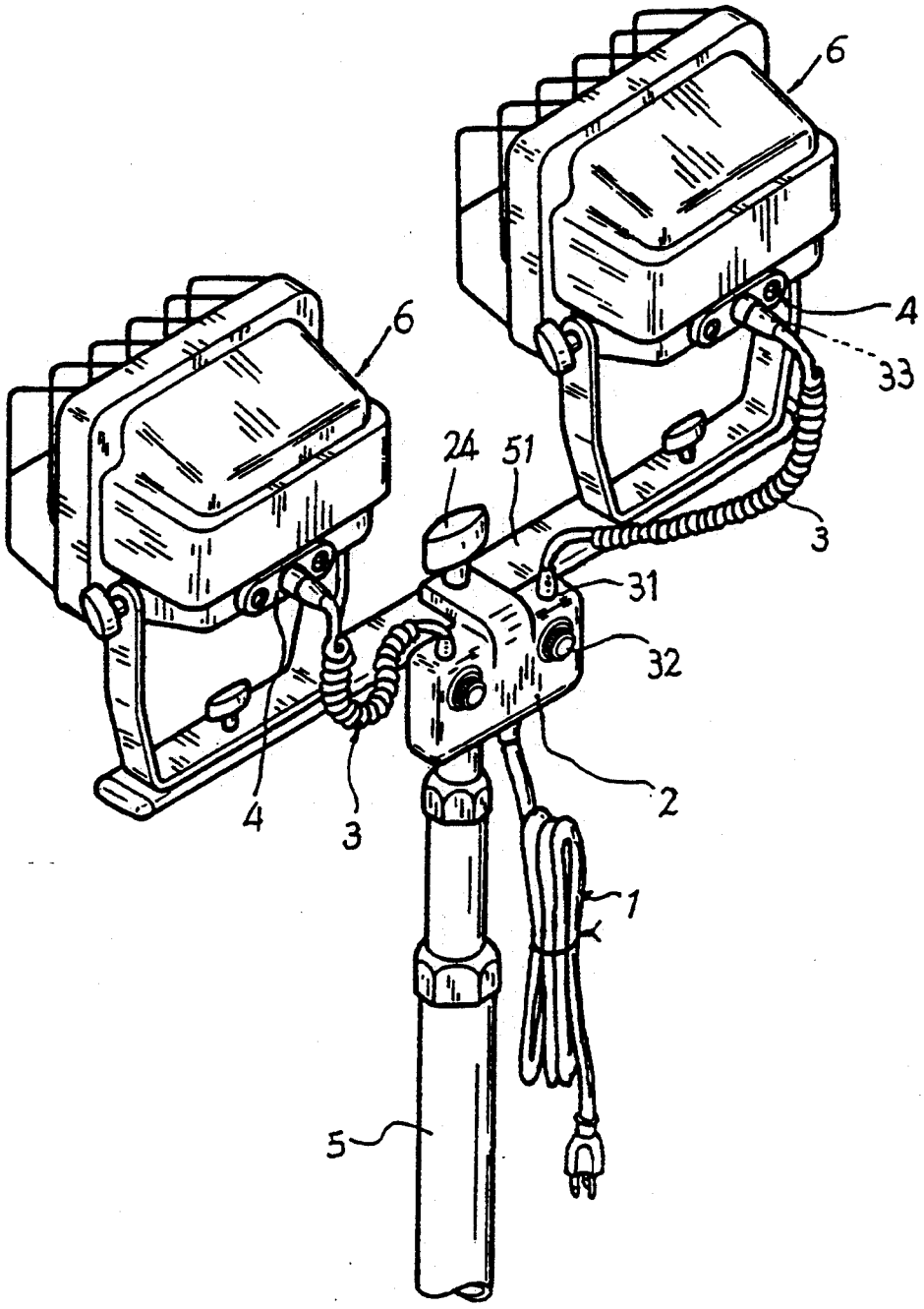
FIG. 1 is a perspective view of the present invention when assembled.

As shown in FIGS. 1-5, the present invention comprises: a main cord 1, an illumination adjusting switch box 2, at least a lamp cord 3 each lamp cord 3 connected between the switch box 2 and a lamp 6 by a lamp adapter 4, and a supporting stand 5 for securing the switch box 2 and the lamp 6 on the stand 5.

Figure 2:
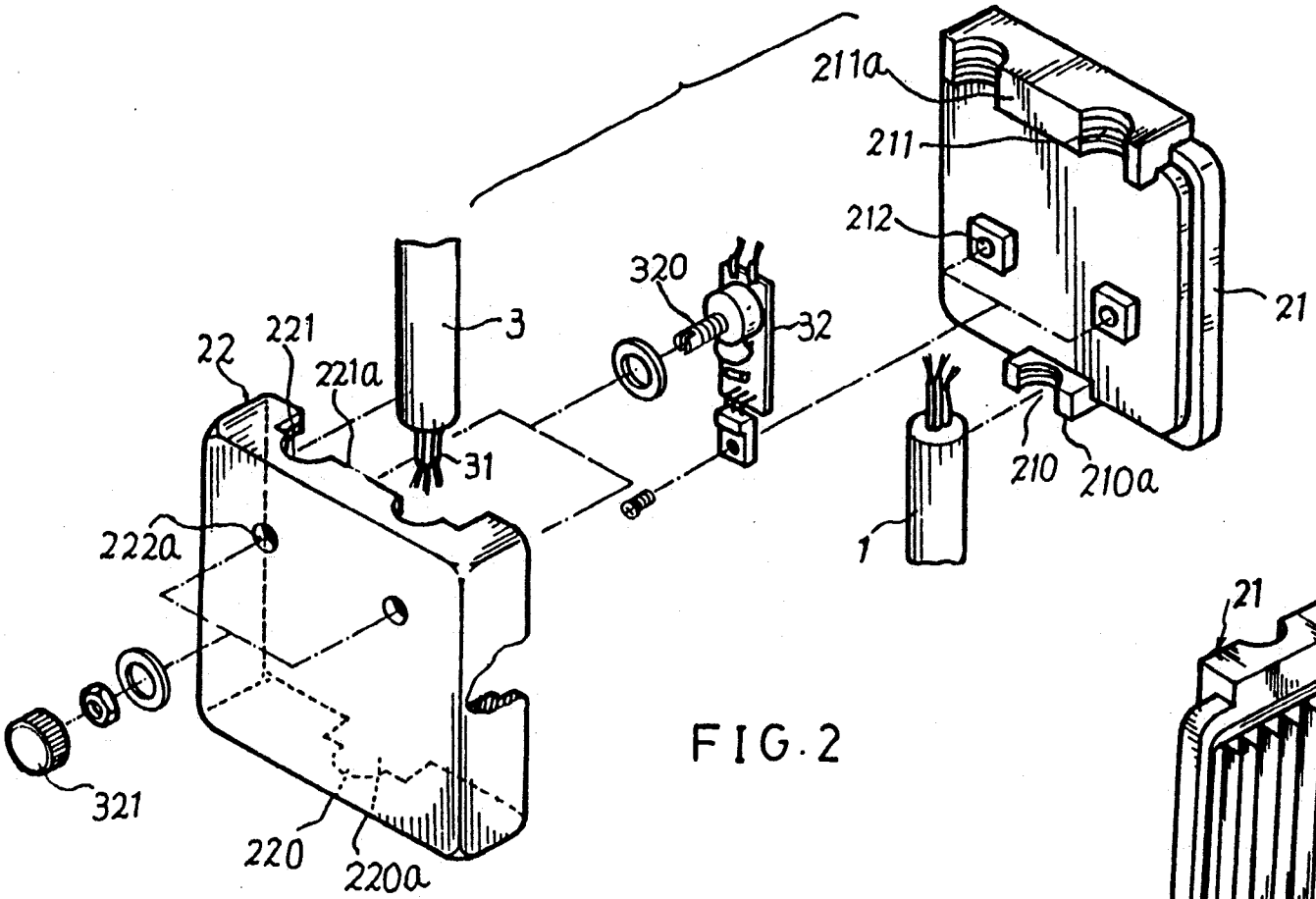
FIG. 2 is an exploded view showing an inner box and its cover of the switch box of the present invention.
Figure 3:
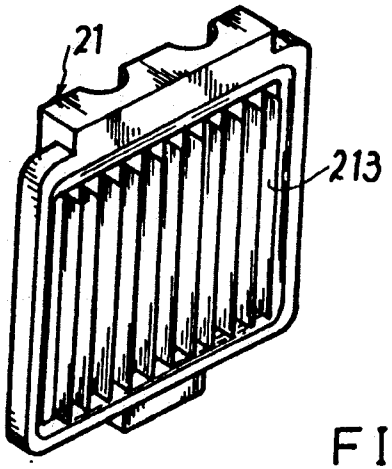
FIG. 3 is a rear view of the inner box when viewed from 3—3 direction of FIG. 2.

The illumination adjusting switch box 2 includes: an inner box 21 having a first lower semi-circular hole 210 recessed in a lug **210*a* formed in a lower portion of the inner box, and at least a first upper semi-circular hole 211 recessed in an extension 211*a* formed in an upper portion of the box, at least a screw base 212 formed in an inner surface of the inner box 21, and a plurality of radiating fins 213 protruding rearwardly outwardly for dissipating heat, which may be integrally formed by aluminum casting process or the like; a box cover 22 having a second lower semi-circular hole 220 recessed in a lug recess 220*a* formed in a lower portion of the cover 22 combinably fastening the main cord 1 with the first lower semi-circular hole 210 formed in the box 21 by engaging the lug 210*a* with the lug recess 220*a*, at least a second upper semi-circular hole 221 recessed in an extension socket 221*a* recessed in an upper portion of the cover 22 combinably fastening a lamp cord 3 with the first upper semi-circular hole 211 formed in the box 21 by engaging the extension 211*a* with the socket 221*a*, and a switch chamber 222 formed in the cover 22 for storing at least one illumination adjusting switch 32 in the chamber 222 having a switch hole 222*a* for rotatably mounting a knob shaft 320 of the switch 32 which is connected between the main cord 1 and the lamp cord 3 in the switch chamber 222; and an outer jacket 23 integrally formed by plastic molding process for coating, sealing and encasing the inner box 21 and the box cover 22 within the outer jacket 23 except a knob portion 321 secured to the knob shaft 320 and the fins 213 protruding through a rear surface 23*a* of the outer jacket 23, with each switch 32 protruding outwardly the knob portion 321, through a switch hole 222*a* which is formed in the box cover 22 communicating the switch chamber 222, to be rotatably sealed in a knob adapter 233 of the jacket 23 generally cylindrical shaped. The outer jacket 23 is formed with a bracket 234 having a bolt hole 234*a* formed in the bracket 234 engageable with a fixing bolt 24 for securing the switch box 2 on the supporting stand 5 or on a branch lever 51 of the stand by engaging the bolt 24 into the bolt hole 234*a* of the bracket 234 and a bolt hole 511 formed in the stand 5** as shown in FIG. 2.

Each said semi-circular hole 211, 221, 210, 220 in the inner box 21 and in the box cover 22 may be formed with a plurality of corrugated threads in the semi-circular hole for firmly fastening the cord 1 or 3 therein.

There are two sets of the lamps 6 and the lamp cords 3 respectively as shown in the drawing figures, but not limited in this invention.

Figure 4A:
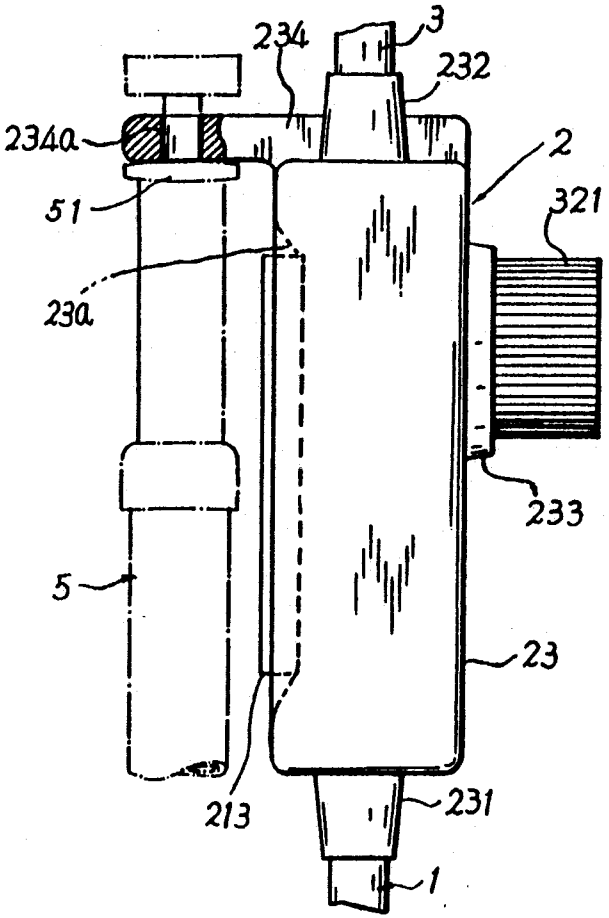
FIG. 4A shows the inner box integrally formed with an outer jacket of the present invention.
Figure 4:
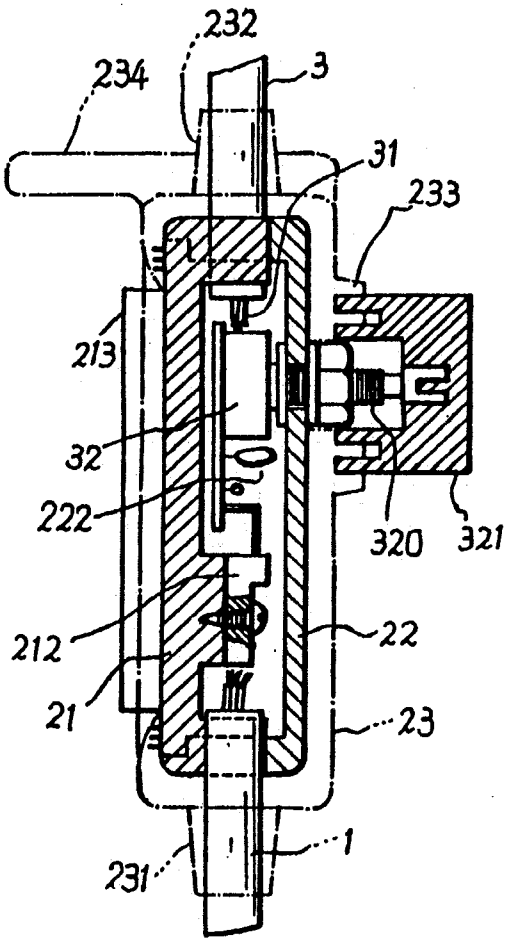
FIG. 4 shows a sectional drawing of the switch box in accordance with the present invention.
Figure 5:
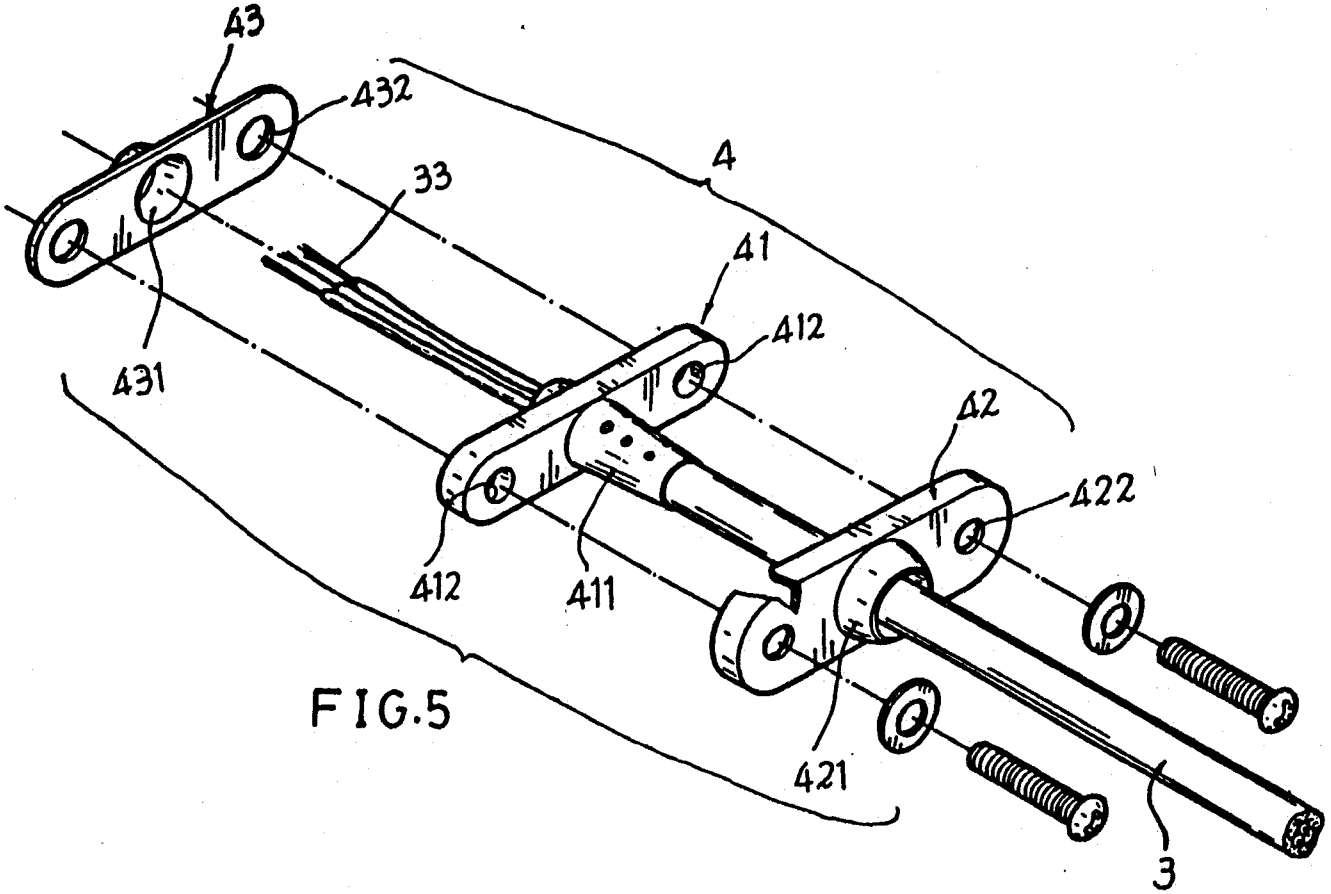
FIG. 5 shows an exploded view of the lamp adapter of the present invention.
Figure 6C:
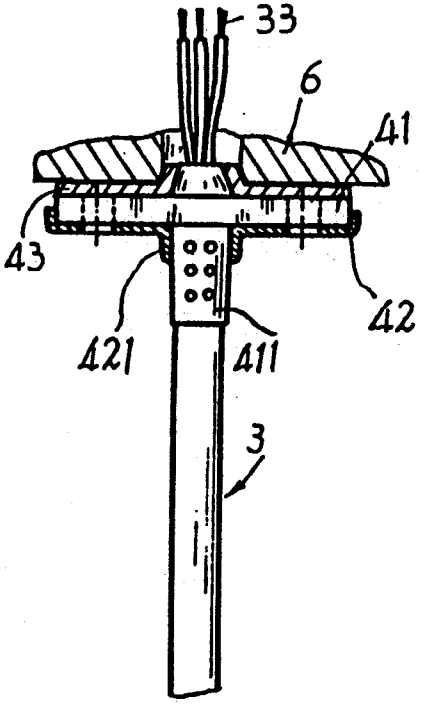
FIGS. 6A, 6B and 6C show the steps for assembling each lamp adapter on each lamp in accordance with the present invention.
Figure 6B:
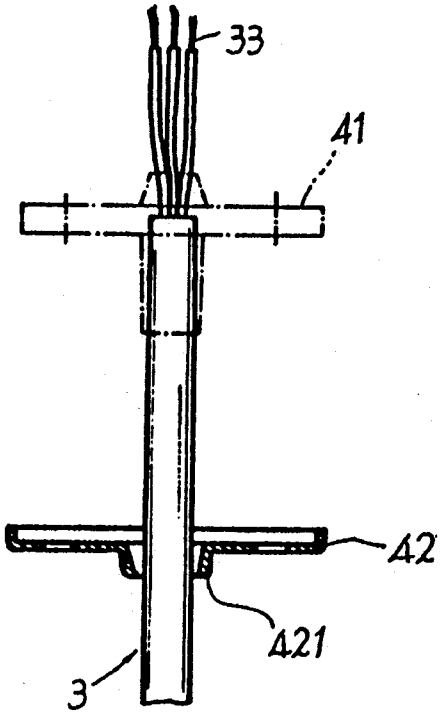
Figure 6A:
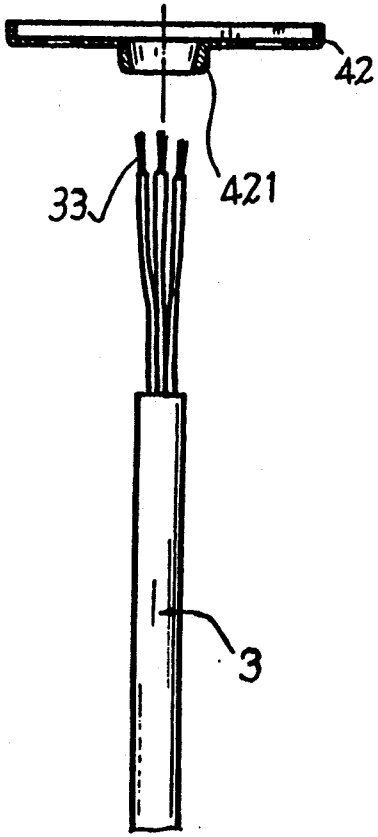

The outer jacket 23 includes a lower reinforcing sleeve 231 encasing a connection or junction portion of the main cord 1 with the switch box 2, and at least an upper reinforcing sleeve 232 encasing a connection or junction portion of the lamp cord 3 with the switch box 2 for reinforcing the cords 1, 3 and for water proof purpose therefor as shown in FIG. 4A.

Each lamp cord 3 has its input terminal 31 connected with the main cord 1 through the switch 32 formed in the switch box 2, and has an output terminal 33 of the lamp cord 3 connected to each lamp 6 secured on the branch lever 51 of the supporting stand 5 by a lamp adapter 4.

Each lamp adapter, as shown in FIGS. 5 and 6A–6C, includes: a connector base 41 having a central reinforcing sleeve 411 for sealably encasing the output terminal 33 of the lamp cord 3 and two screw holes 412 in the base 41; a shielding cover 42 having a central sleeve fastener 421 for fastening the central reinforcing sleeve 411 of the connector base 41 and two screw holes 422 in the cover 42; and a heat-resistant packing member 43 preferably made of silicon rubber having a central cord hole 431 for passing through the lamp cord 3 therein for connecting the lamp cord 3 with the lamp 6, and two screw holes 432 in the packing member 43, whereby upon an insertion of two screws through all the screw holes 422, 412, 432 in the cover 42, base 41 and packing member 43, the lamp adapter 4 can be secured to the lamp 6 such as a rear portion of a lamp shade as shown in FIG. 1.

Figure 7:
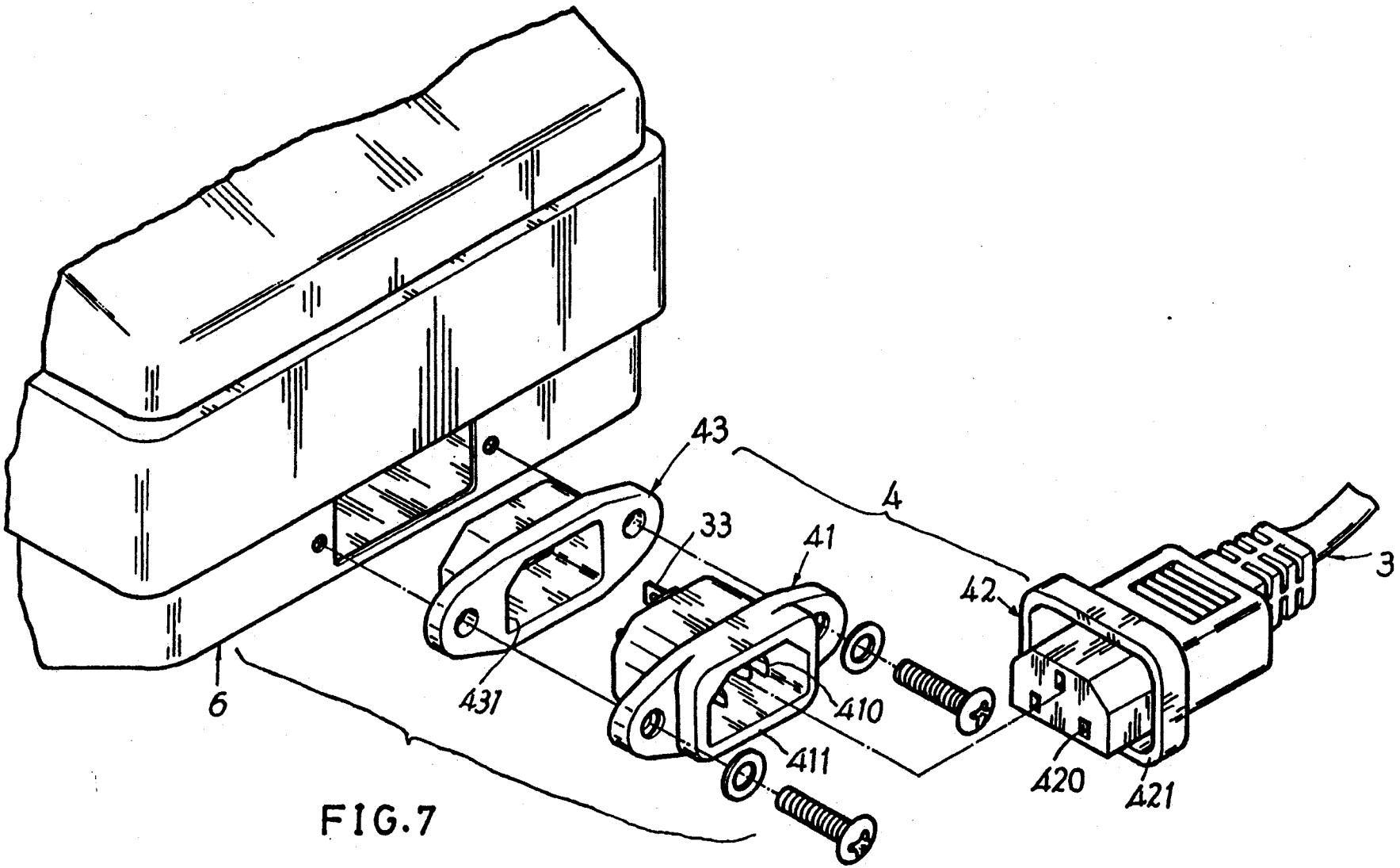
FIG. 7 shows another preferred embodiment of the lamp adapter of the present invention.

As shown in FIG. 7, the lamp adapter 4 may be modified to include: a connector base 41 having a plurality of plug pins 410 in the base 41 connected with an output terminal 33 of the lamp cord 3 and a reinforcing sleeve 411 disposing around the pins 410; a shielding cover 42 having a plurality of pin sockets 420 recessed in the cover 42 engageable with the pins 410 in the base 41 and electrically connected to the lamp cord 3 and having a sleeve fastener 421 disposing around the pin sockets 420 engageable with the reinforcing sleeve 411 of the base 41 for coupling the cover 42 with the base 41; and a packing member 43 preferably made of silicon rubber for heat resistant purpose retained between the base 41 and the lamp 6 when securing the base 41 and the cover 42 with the lamp 6.

The present invention is superior to an electrical cord system of a conventional lighting fixture with the following advantages:

1. The illumination-adjusting switch box 2 includes an integrally formed outer jacket 23 encasing the inner box 21 for ensuring a water-proof of the electrical cord system for safety purpose.

2. Easier assembly of the power supply system for a lighting fixture can be achieved by this invention for reducing labor cost, and for a convenient assembly and better maintenance for an electrical cord system especially beneficial for an exterior lighting use.

3. The radiating fins 213 provided on the switch box 2 may efficiently dissipate the heat in the box 2 outwardly for enhancing an electrical safety.

I claim:

1. An electrical cord assembly for lighting fixture comprising:

a supporting stand;

a main cord connected with a power supply;

an illumination adjusting switch box secured on said supporting stand including an inner box for storing at least an illumination adjusting switch in said box, a box cover shielding the inner box for fastening the main cord in between the inner box and said box cover, and an outer jacket integrally formed on said inner box and said box cover to encase said inner box and said box cover in said outer jacket, said inner box having a plurality of radiating fins protruding rearwardly through said outer jacket for heat dissipating use;

at least a lamp cord having its input terminal connected with said main cord through said illumination adjusting switch in said switch box and having an output terminal of the lamp cord connected to a lamp secured on said supporting stand by a lamp adapter;

said illumination adjusting switch box including: said inner box having a first lower semi-circular hole formed in a lower portion of the inner box, and at least a first upper semi-circular hole formed in an upper portion of the box; said box cover having a second lower semi-circular hole formed in a lower portion of the cover combinably fastening the main cord with the first lower semi-circular hole formed in the box, at least a second upper semi-circular hole formed in an upper portion of the cover combinably fastening the lamp cord with the first upper semi-circular hole formed in the box, and a switch chamber formed in the box for storing at least one said illumination adjusting switch connected between the main cord and the lamp cord in the switch chamber; and said outer jacket integrally formed by plastic molding process for coating, sealing and encasing the inner box and the box cover within the outer jacket, each said illumination adjusting switch having a knob shaft protruding outwardly through a switch hole formed in the box cover communicating the switch chamber to be connected with a knob portion which is rotatably sealed in a knob adapter of said outer jacket.

2. An electrical cord assembly according to claim 1, wherein each said first semi-circular hole of the inner box is recessed in an extension or lug formed in the inner box engageable with an extension socket or lug recess which is recessed in said box cover and is further recessed to form said semi-circular hole in the box cover for a firm coupling of the first and second semi-circular holes for combining the inner box and the box cover.

3. An electrical cord assembly according to claim 1, wherein each said semi-circular hole in the inner box and in the box cover is formed with a plurality of corrugated threads in the semi-circular hole for firmly fastening the main and lamp cords therein.

4. An electrical cord assembly according to claim 1, wherein said outer jacket includes a lower reinforcing sleeve encasing a connection portion of the main cord with the switch box, and at least an upper reinforcing sleeve encasing a connection portion of the lamp cord with the switch box for reinforcing the main and lamp cords and for water proof purpose.

5. An electrical cord assembly according to claim 1, wherein each said lamp adapter includes: a connector base having a central reinforcing sleeve for sealably encasing the output terminal of the lamp cord and two screw holes in the base; a shielding cover having a central sleeve fastener for fastening the central reinforcing sleeve of the connector base and two screw holes in the cover; and a heat-resistant packing member having a central cord hole for passing through the lamp cord therein for connecting the lamp cord with the lamp, and two screw holes in the packing member, whereby upon an insertion of two screws through the screw holes respectively formed in the cover, the base and the packing member, the lamp adapter can be secured to the lamp.

6. An electrical cord assembly according to claim 1, wherein the lamp adapter includes: a connector base having a plurality of plug pins in the base connected with an output terminal of the lamp cord and a reinforcing sleeve disposing around the pins; a shielding cover having a plurality of pin sockets recessed in the cover engageable with the pins in the base and electrically connected to the lamp cord and having a sleeve fastener disposing around the pin sockets engageable with the reinforcing sleeve of the base for coupling the cover with the base to be secured to the lamp.

* * * * *